US009437199B2

(12) United States Patent
Marchand et al.

(10) Patent No.: US 9,437,199 B2
(45) Date of Patent: Sep. 6, 2016

(54) METHOD AND DEVICE FOR SEPARATING SIGNALS BY MINIMUM VARIANCE SPATIAL FILTERING UNDER LINEAR CONSTRAINT

(71) Applicants: UNIVERSITE BORDEAUX 1, Talence (FR); CENTRE NATIONAL DE LA RECHERCHE SCIENTIFIQUE (CNRS), Paris (FR)

(72) Inventors: Sylvain Marchand, Brest (FR); Stanislaw Gorlow, Paris (FR)

(73) Assignees: UNIVERSITÉ BORDEAUX 1, Talence (FR); CENTRE NATIONAL DE LAS RECHERCHE SCIENTIFIQUE (C, Paris (FR)

( * ) Notice: Subject to any disclaimer, the term of this patent is extended or adjusted under 35 U.S.C. 154(b) by 0 days.

(21) Appl. No.: 14/431,309

(22) PCT Filed: Sep. 25, 2013

(86) PCT No.: PCT/EP2013/069937

§ 371 (c)(1),
(2) Date: Mar. 26, 2015

(87) PCT Pub. No.: WO2014/048970

PCT Pub. Date: Apr. 3, 2014

(65) Prior Publication Data

US 2015/0243290 A1 Aug. 27, 2015

(30) Foreign Application Priority Data

Sep. 27, 2012 (FR) ..... 12 59115

(51) Int. Cl.
*G10L 19/008* (2013.01)
*G10L 19/018* (2013.01)
*G10L 21/028* (2013.01)

(52) U.S. Cl.
CPC ..... *G10L 19/008* (2013.01); *G10L 19/018* (2013.01); *G10L 21/028* (2013.01)

(58) Field of Classification Search
None
See application file for complete search history.

(56) References Cited

U.S. PATENT DOCUMENTS 6,321,200 B1 * 11/2001 Casey ..... G10L 15/02 704/500
6,845,164 B2 * 1/2005 Gustafsson ..... G06K 9/6243 381/66

(Continued)

OTHER PUBLICATIONS

Stanislow Gorlow et al., "Informed Audio Source Separation Using Linearly Constrained Spatial Filters", IEEE Transactions on Audio, Speech, and Language Processing, Issue 21.1, Jan. 2013, pp. 1-11.

(Continued)

*Primary Examiner* — Brenda Bernardi
(74) *Attorney, Agent, or Firm* — MH2 Technology Law Group, LLP

(57) ABSTRACT

The invention relates to a method and the associated device 1 for separating one or more particular digital audio source signals ($s_i$) contained in a mixed multichannel digital audio signal ($s_{mix}$) obtained by mixing a plurality of digital audio source signals ($s_1, \ldots, s_p$). According to the invention:

the modulus of the amplitude or the normalized power of the particular source signal(s) ($s_i$) is determined from representative values of said particular source signal(s) contained in the mixed signal; and then linearly constrained minimum variance spatial filtering is performed on the mixed signal in order to obtain each particular source signal ($s'_i$), said filtering being based on the distribution of said particular source signal between at least two channels of the mixed signal, and the modulus of the amplitude or the normalized power of said particular source signal is used as a linear constraint of the filter.

11 Claims, 1 Drawing Sheet

(56) References Cited

U.S. PATENT DOCUMENTS

| | | | | |
|---|---|---|---|---|
| 7,747,001 | B2 * | 6/2010 | Kellermann | H04M 9/082 379/406.01 |
| 7,917,336 | B2 | 3/2011 | Parra et al. | |
| 2006/0050898 | A1 * | 3/2006 | Yamada | H04S 1/002 381/104 |
| 2007/0135952 | A1 * | 6/2007 | Chubarev | G10L 19/008 700/94 |
| 2012/0029916 | A1 * | 2/2012 | Tsujikawa | G10L 19/008 704/231 |
| 2012/0099732 | A1 | 4/2012 | Visser | |
| 2013/0031152 | A1 * | 1/2013 | Sun | G06K 9/6243 708/315 |
| 2013/0083942 | A1 * | 4/2013 | hgren | G01S 3/8006 381/92 |

OTHER PUBLICATIONS

PCT Written Opinion of the International Searching Authority issued Feb. 6, 2014, International Application No. PCT/EP2013/069937, pp. 1-18 (including English language translation of document).

Antoine Liutkus et al Informed source separation through spectrogram coding and data embedding Signal Processing vol. 92, No. 8, Aug. 1, 2012 pp. 1937-1949ISSN: 0165-1684.

Lucas C Parra et al Geometric Source Separation: Merging Convolutive Source Separation With Geometric Beamforming IEEE Transactions on Speech and Audio Processing, IEEE Service Center, New York, NY, US vol. 10, No. 6, Sep. 1, 2002 ISSN: 1063-6676.

Antoine Liutkus et al Informed audio source separation: A comparative study Signal Processing Conference (EUSIPCO), 2012 Proceedings of the 20th European, IEEE, Aug. 27, 2012 pp. 2397-2401.

Stanislaw Gorlow et al Informed source separation: Underdetermined source signal recovery from an instantaneous stereo mixture Applications of Signal Proceesing to Audio and Acoustics (WASPAA), 2011 IEEE Workshop On, IEEE Oct. 16, 2011.

* cited by examiner

METHOD AND DEVICE FOR SEPARATING SIGNALS BY MINIMUM VARIANCE SPATIAL FILTERING UNDER LINEAR CONSTRAINT

TECHNICAL FIELD

The present disclosure relates to a method for separating certain source signals making up an overall digital audio signal. The disclosure also relates to a device for performing the method.

BACKGROUND

Signal mixing consists in summing a plurality of signals, referred to as source signals, in order to obtain one or more composite signals, referred to as mixed signals. In audio applications in particular, mixing may consist merely in a step of adding source signals together, or it may also include steps of filtering signals before and/or after adding them together. Furthermore, for certain applications such as compact disk (CD) audio, the source signals may be mixed in different manners in order to form two mixed signals corresponding to the two (left and right) channels or paths of a stereo signal.

Separating sources consists in estimating the source signals from an observation of a certain number of different mixed signals made from those source signals. The purpose is generally to heighten one or more target source signals, or indeed, if possible, to extract them completely. Source separation is difficult in particular in situations that are said to be "underdetermined", in which the number of mixed signals available is less than the number of source signals present in the mixed signals. Extraction is then very difficult or indeed impossible because of the small amount of information available in the mixed signals compared with that present in the source signals. A particularly representative example is constituted by CD audio music signals, since there are only two stereo channels available (i.e. a left mixed signal and a right mixed signal), which two signals are generally highly redundant, and apply to a number of source signals that is potentially large.

There exist several types of approach for separating source signals: these include blind separation; computational auditory scene analysis; and separation based on models. Blind separation is the most general form, in which no information is known a priori about the source signals or about the nature of the mixed signals. A certain number of assumptions are then made about the source signals and the mixed signals (e.g. that the source signals are statistically independent), and the parameters of a separation system are estimated by maximizing a criterion based on those assumptions (e.g. by maximizing the independence of the signals obtained by the separator device). Nevertheless, that method is generally used when numerous mixed signals are available (at least as many as there are source signals), and it is therefore not applicable to underdetermined situations in which the number of mixed signals is less than the number of source signals.

Computational auditory scene analysis generally consists in modeling source signals as partials, but the mixed signal is not explicitly decomposed. This method is based on the mechanisms of the human auditory system for separating source signals in the same manner as is done by our ears. Mention may be made in particular of: D. P. W. Ellis, *Using knowledge to organize sound: The prediction-driven approach to computational auditory scene analysis, and its application to speech/non-speech mixture* (Speech Communication, 27(3), pp. 281-298, 1999); D. Godsmark and G. J. Brown, A blackboard architecture for computational auditory scene analysis (Speech Communication, 27(3), pp. 351-366, 1999); and also T. Kinoshita, S. Sakai, and H. Tanaka, *Musical source signal identification based on frequency component adaptation* (In Proc. IJCAI Workshop on CASA, pp. 18-24, 1999). Nevertheless, at present computational auditory scene analysis gives rise to results that are insufficient in terms of the quality of the separated source signals.

Another form of separation relies on decomposition of the mixture on the basis of adaptive functions. There exist two major categories: parsimonious time decomposition and parsimonious frequency decomposition.

For parsimonious time decomposition, the waveform of the mixture is decomposed, whereas for parsimonious frequency decomposition, it is its spectral representation that is decomposed, thereby obtaining a sum of elementary functions referred to as "atoms" constituting elements of a dictionary. Various algorithms can be used for selecting the type of dictionary and the most likely corresponding decomposition. For the time domain, mention may be made in particular of: L. Benaroya, *Représentations parcimonieuses pour la séparation de sources avec un seul capteur* [Parsimonious representations for separating sources with a single sensor] (Proc. GRETSI, 2001); or P. J. Wolfe and S. J. Godsill, *A Gabor regression scheme for audio signal analysis* (Proc. IEEE Workshop on Applications of Signal Processing to Audio and Acoustics, pp. 103-106, 2003). In the method proposed by Gribonval (R. Gribonval and E. Bacry, *Harmonic decomposition of audio signals with matching pursuit*, IEEE Trans. Signal Proc., 51(1) pp. 101-112, 2003), the decomposition atoms are classified into independent subspaces, thereby enabling groups of harmonic partials to be extracted. One of the restrictions of that method is that generic dictionaries of atoms, such as Gabor atoms for example, that are not adapted to the signals, do not give good results. Furthermore, in order for those decompositions to be effective, it is necessary for the dictionary to contain all of the translated forms of the waveforms of each type of instrument. The decomposition dictionaries then need to be extremely voluminous in order for the projection, and thus the separation, to be effective.

In order to mitigate that problem of invariance under translation that appears in the time situation, there exist approaches for parsimonious frequency decomposition. Mention may be made in particular of M. A. Casey and A. Westner, *Separation of mixed audio sources by independent subspace analysis*, Proc. Int. Computer Music Conf., 2000, which introduces independent subspace analysis (ISA). Such analysis consists in decomposing the short-term amplitude spectrum of the mixed signal (calculated by a short-term Fourier transform (SIFT)) on the basis of atoms, and then in grouping the atoms together in independent subspaces, each subspace being specific to a source, in order subsequently to resynchronize the sources separately. Nevertheless, that is generally limited by several factors: the resolution of SIFT spectral analysis; the superposition of sources in the spectral domain; and spectral separation being restricted to amplitude (the phase of the resynchronized signals being that of the mixed signal). It is thus generally difficult to represent the mixed signal as being a sum of independent subspaces because of the complexity of the sound scene in the spectral domain (considerable overlap of the various components) and because of the way the contribution of each component in the mixed signal varies as a function of time. Methods are often evaluated on the basis of "simplified" mixed signals that are well controlled (the source signals are MIDI instruments or are instruments that are relatively easy to separate, and few in number).

Another method of separating sources is "informed" source separation: information about one or more source signals is transmitted to the decoder together with the mixed signal. On the basis of algorithms and of said information, the decoder is then capable of separating at least one source signal from the mixed signal, at least in part. An example of informed source separation is described by M. Parvaix and L. Girin, *Informed source separation of linear instantaneous underdetermined audio mixtures by source index embedding*, IEEE Trans. Audio Speech Lang. Process., Vol. 19, pp. 1721-1733, August 2011. The information transmitted to the decoder specifies in particular the two predominant source signals in the mixed signal, for various frequency ranges. Nevertheless, such a method is not always appropriate when more than two source signals exist that are contributing simultaneously in a common frequency range of the mixed signal: under such circumstances, at least one source signal becomes neglected, thereby creating a "spectral hole" in the reconstruction of said source signal.

It is also known, in particular in the field of telecommunications, to filter signals that have been picked up using a plurality of sensors as a function of the positions of said signals in three-dimensional space relative to said sensors. That constitutes spatial filtering (or indeed "beamforming") that serves to give precedence to the signal in a given spatial direction, while filtering out signals coming from other directions. An example of such filters are linearly constrained minimum variance (LCMV) spatial filters. An example of such a filter is disclosed in particular in Document EP 1 633 121.

SUMMARY

An object of the present disclosure is thus to propose a method making it possible to separate more effectively source signals contained in one or more mixed signals.

To this end, in an embodiment, there is provided a method for separating, at least in part, one or more particular digital audio source signals contained in a mixed multichannel digital audio signal (i.e. a signal having at least two channels), e.g. a stereo signal. The mixed signal is obtained by mixing a plurality of digital audio source signals and it includes representative values of the particular source signal(s). The method comprises the steps of:

- determining the modulus of the amplitude or the normalized power of the particular source signal(s) from the representative values of said particular source signal(s) contained in the mixed signal; and then
- performing linearly constrained minimum variance spatial filtering in order to obtain, at least in part, each particular source signal, said filtering being based on the distribution of said particular source signal between at least two channels of the mixed signal, and the modulus of the amplitude or the normalized power of said particular source signal being used as a linear constraint of the filter.

The representative values may be the temporal, spectral, or spectro-temporal distribution of the particular source signal, or the temporal, spectral, or spectro-temporal contribution of the particular source signal in the mixed signal. The representative values of the source signals may thus be in amplitude modulus or in normalized power (i.e. in energy, which corresponds to the square of the modulus of the amplitude): the representative values may thus be the amplitude modulus values or the normalized power (or energy) values.

By way of example, the representative values may be the temporal, spectral, or spectro-temporal distribution of the particular source signal, or the temporal, spectral, or spectro-temporal contribution of the particular source signal in the mixed signal, for a plurality of zones (or points) in a time-frequency plane. Under such circumstances, the amplitude modulus or the normalized power of the particular source signal(s) may be determined in the time-frequency plane: the amplitude moduluses and the normalized powers are spectro-temporal values.

A transform or a representation into the time-frequency plane consists in representing the source signal in terms of energy (or normalized power) or of amplitude modulus (i.e. the square root of energy) as a function of two parameters: time and frequency. This corresponds to how the frequency content of the source signal varies in energy or in modulus as a function of time. Thus, for a given instant and a given frequency, a real positive value is obtained that corresponds to the components of the signal at that frequency and at that instant. Examples of theoretical formulations and of practical implementations of time-frequency representations have already been described (L. Cohen: Time-frequency distributions, a review, Proceedings of the IEEE, Vol. 77, No. 7, 1989; F. Hlawatsch, F. Auger: *Temps-fréquence, concepts et outils* [Time-frequency, concepts and tools], Hermés Science, Lavoisier 2005; and P. Flandrin: *Temps fréquence* [Time frequency], Hermés Science, 1998).

Thus, using the described method, it is possible to use spatial filtering improved by the information contained in the mixed signal to separate effectively the particular source signals without making assumptions about those various signals (other than conventional statistical assumptions, i.e.: independence of the source signals, zero average of the source signals, Gaussian distribution). In particular, the method is based on the distribution of each source signal between the various channels of the mixed signal in order to isolate the source signals (spatial filtering). The use of a linearly constrained minimum variance filter serves to obtain high performance spatial separation by using as a constraint the modulus of the amplitude or the normalized power of the source signal. It is thus possible to decorrelate a particular source signal of the mixed signal spatially and at the same time to adjust the amplitude of the separated signal to the desired level. This improves the spatial filtering step by taking into consideration the representative value of the particular source signal that is known.

In particular, it is possible simultaneously to isolate the various particular source signals present in the mixed signal, e.g. by using as many spatial filters as there are source signals to be separated.

Preferably, the filtering is also based on the modulus of the amplitude or the normalized power of the particular source signals. More precisely, the spatial filtering step may comprise modeling a spatial correlation matrix using the modulus of the amplitude or the normalized power of the particular source signals and the distribution of said particular source signal between at least two channels of the mixed signal.

Preferably, the mixed signal includes representative values of the particular source signal(s) for at least two channels of the mixed signal, and, prior to performing spatial filtering, the mixed signal and said representative values of the particular signals are used to determine the distribution of each particular source signal between said at least two channels of the mixed signal.

Alternatively, the distribution of the particular source signal(s) between at least two channels of said mixed signal may be received as input, e.g. in the mixed signal.

In other words, the distribution of the particular source signals between the various channels of the mixed signal may be provided when performing the separation method, e.g. at the same time as the representative values of said particular source signals, or else it may be determined during the separation method on the basis of the multichannel mixed signal and of the representative values of the particular source signals.

In an embodiment, determining the modulus of the amplitude or the normalized power of the particular source signal(s) comprises extracting representative values of the particular source signals that have been inserted into the mixed signal, e.g. by watermarking. The extraction of representative values stems from representative values of the particular source signals being transmitted, which may take place together with the mixed signal, e.g. when the information is watermarked or inserted in inaudible manner in the mixed signal, or else via a particular channel of the mixed signal which is dedicated to transmitting said representative values.

In another aspect, the disclosure provides a device for separating, at least in part, one or more particular digital audio source signals contained in a multichannel mixed digital audio signal. The mixed signal is obtained by mixing a plurality of digital audio source signals and including representative values of the particular source signal(s). The device comprises:

determination means for determining the modulus of the amplitude or the normalized power of the particular source signal(s) from the representative values of said particular source signal(s) contained in the mixed signal; and a linearly constrained minimum variance spatial filter adapted to isolate, at least in part, each particular source signal from the mixed signal, said filter being based on the distribution of said particular source signal between at least two channels of the mixed signal, and the modulus of the amplitude or the normalized power of said particular source signal being used as a linear constraint.

Preferably, the mixed signal is a stereo signal.

Preferably, the mixed signal includes representative values of the particular source signal(s) for at least two channels of the mixed signal, and the device includes determination means for determining the distribution of each particular source signal between said at least two channels of the mixed signal from the mixed signal and from said representative values of the particular source signals.

Preferably, the means for determining the modulus of the amplitude or the normalized power comprise extractor means for extracting the representative values of the particular source signal(s) that have been inserted in the mixed signal, e.g. by watermarking.

BRIEF DESCRIPTION OF THE FIGURES

The disclosure can be better understood in the light of a particular embodiment described by way of non-limiting example and shown in the accompanying drawing, in which.

DETAILED DESCRIPTION

Figure 1:
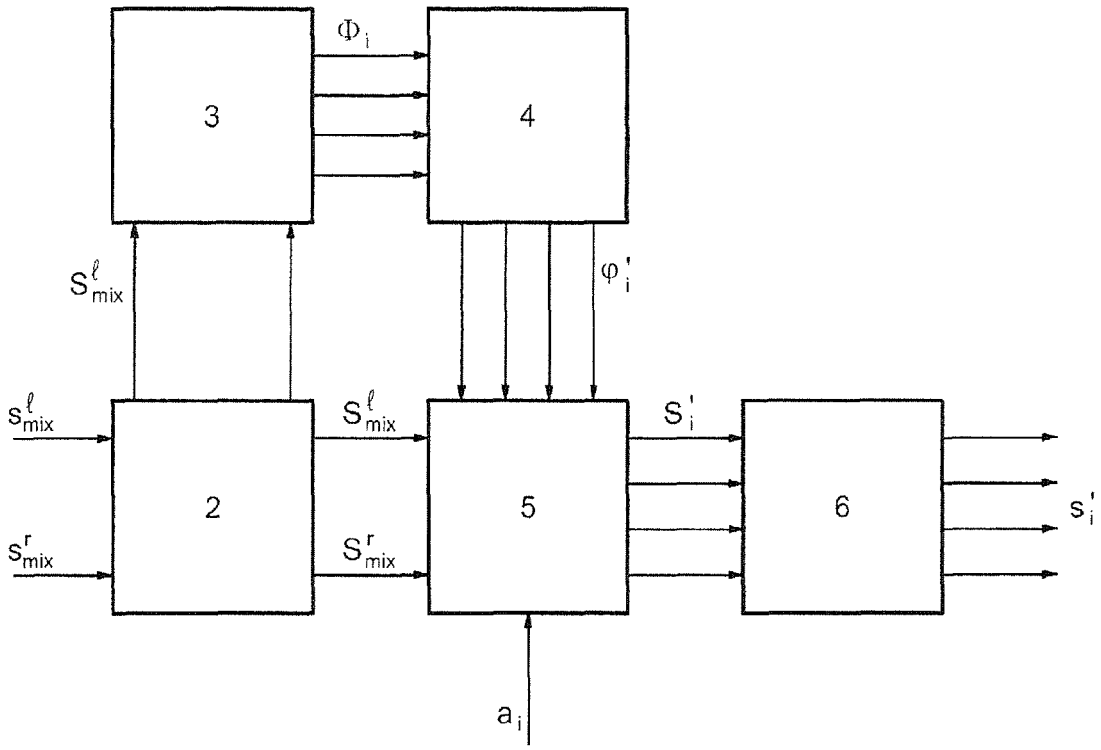
FIG. 1 is a diagram of an embodiment of a separator device of the disclosure.

In the detailed description below, it is considered that the mixed signal $s_{mix}(t)$ is a stereo signal having a left channel $s_{mix}^{l}(t)$ and a right channel $s_{mix}^{r}(t)$, and comprises p source signals $s_1(t), \ldots, s_p(t)$. The mixed signal $s_{mix}(t)$ may be written as the product of the p source signals multiplied by a mixing matrix A:

$$A=[a_1^l, \ldots, a_p^l]=[a_1, \ldots, a_p]$$
$$[a_1^r, \ldots, a_p^r]$$

where $a_i=[a_i^l, a_i^r]^T$ (where $^T$ represents the transpose of the matrix) and $a_i^l$ and $a_i^r$ represent the distribution of the source signal i in each of the channels of the mixed signal: $(a_i^l)^2+(a_i^r)^{2=1}$.

More precisely, the coefficients $a_i^l$ and $a_i^r$ may be written in the following form: $a_i^l=\sin(\theta_i)$ and $a_i^r=\cos(\theta_1)$ where $\theta_1$ represents the balance of the source signal i between the two channels of the mixed signal.

In other words, the following applies:

$$s_{mix}(t)=A\cdot s(t)$$

with: $s_{mix}(t)=[s_{mix}^{l}(t), s_{mix}^{r}(t)]^T$ and $s(t)=[s_1(t), \ldots, s_p(t)]^T$ (where $^T$ represents the transpose).

Furthermore, in the description below, it is considered that the signals are audio signals.

In the context of the present description, consideration is given to the short-term Fourier transform as the transform in the time-frequency plane. The transform of the source signal i in the time-frequency plane is thus written as follows:

$$S_i(k,m)=\Sigma s_i(k+n)f(n)e^{-2i\pi mn/N}$$

where N is a constant and f(n) is a window function of the short-term Fourier transform.

In the description below, it is considered that the linear constraint of the spatial filter is normalized power. For a given source signal $s_i$, and for a given point (k,m) in the time-frequency plane, the normalized energy or power ($\phi_i$(k,m) is thus obtained as follows:

$$\phi_i(k,m)=|S_i(k,m)|^2$$

The value representative of the source signal may thus be $|S_i(k,m)|$ (the modulus value) or else $\phi_i(k,m)$ (energy value equal to the normalized power value). The value representative of the source signal may also be the logarithm of the energy value:

$$\Phi_i=10\log_{10}(\phi_i(k,m))$$

The value representative of the source signal may also be determined after applying treatments to the source signal, e.g. by reducing the frequency resolution of the energy spectrum or indeed by adapting the quantification of representative values to the sensitivity of the human ear. It is then possible to obtain values representative of the source signals that are less voluminous in terms of size, while maintaining desired sound quality.

In the description below, it is considered that the value representative of the source signals is a quantified normalized power (or energy) value $\Phi_i(k,m)$.

The values representative of the source signals $\Phi_i(k,m)$ are transmitted to the separator device or decoder. They may be transmitted via a dedicated channel (associated with the stereo channels in order to form the mixed signal), or by being incorporated in the mixed signal, e.g. by watermarking or by using unused bits of the mixed signal. When using unused bits, the separator device may include representative value extractor means that receive as input the mixed signal and that deliver as output the representative values of the source signals.

Likewise, the separator device may also receive the distributions of the source signals in each channel of the mixed signal: $a_1^l, \ldots, a_p^l, a_1^r, \ldots, a_p^r$. These distributions may be transmitted over a dedicated channel (associated with the stereo channels in order to form the mixed signal, or independent from the stereo channels), or by being incorporated in the mixed signal, e.g. by watermarking or by using unused bits of the mixed signal. When using unused bits, the separator device may include source channel distribution extractor means receiving as input the mixed signal and delivering as output the distributions of the source signals. The representative value extractor means and the distribution extractor means may be the same single means.

Alternatively, the separator device may include determination means for determining the distributions of the source signals: such determination means may receive as input the mixed signal and the representative values $\Phi_i(k,m)$, and may deliver as output the distribution of said source signal $a_i^l, a_i^r$. This is possible in particular when each channel of the mixed signal includes the representative values of a source signal for said channel of the mixed signal: in other words, the representative values of a given source signal are not the same for each channel of the mixed signal, with the difference between the representative values of the same source signal for the various channels of the mixed signal making it possible to determine the distribution of said source signal between the various channels of the mixed signal.

FIG. 1 is a diagram of an embodiment of a separator device 1 for separating particular source signals contained in a mixed signal $s_{mix}$. The separator device 1 receives as input the stereo channels $s_{mix}^l$ and $s_{mix}^r$ of the mixed signal $s_{mix}$, and it delivers particular source signals $s'_i$ that are separated at least in part, with 1 varying from 1 to p. The separator device 1 serves to deliver, at least in part, a plurality of particular source signals contained in the mixed signal $s_{mix}$ by using the representative values of said particular source signals $\Phi_i(k,m)$.

In the present description, it is considered that the separator device 1 receives as input the channels of the mixed digital audio signal $s_{mix}^l(t)$ and $s_{mix}^r(t)$, having inserted therein, e.g. by watermarking, the representative values of the particular source signals $\Phi_i(k,m)$, and possibly also the distributions $a_1^l, \ldots, a_p^l, a_1^r, \ldots, a_p^r$ of the particular source signals between the two channels of the mixed digital audio signal $s_{mix}^r(t)$ and $s_{mix}^l(t)$.

The separator device 1 has transform means 2, extractor means 3, treatment means 4, filter means 5, and inverse transform means 6.

The transform means 2 receive as input the channels $s_{mix}^l(t)$ and $s_{mix}^r(t)$ of the mixed digital audio signal and as output it delivers the transforms $S_{mix}^l(k,m)$ and $S_{mix}^r(k,m)$ of the channels of the mixed signal in the time-frequency plane.

The extractor means 3 receive as input the transforms of the channels $S_{mix}^r(k,m)$ and $S_{mix}^l(k,m)$ of the mixed signal in the time-frequency plane, and it delivers the representative values $\Phi_i(k,m)$ of the particular source signals contained in the mixed signal. Where appropriate, the extractor means 3 may also deliver the distributions $a_1^l, \ldots, a_p^l, a_1^r, \ldots, a_p^r$ of the particular source signals between the two channels $s_{mix}^r(t)$ and $s_{mix}^l(t)$ of the mixed digital audio signal, when these are inserted in the mixed signal. The extractor means 3 thus make it possible to extract from the mixed signal the representative values that have been added thereto a posteriori, e.g. by watermarking, and to isolate them from the mixed signal. The representative values $\Phi_i(k,m)$ are then transmitted to the treatment means 4, and where appropriate, the distributions $a_1^l, \ldots, a_p^l, a_1^r, \ldots, a_p^r$ are transmitted to the filter means 5.

It should be observed that the extractor means 3 may alternatively receive directly as input the channels $s_{mix}^r(t)$ and $s_{mix}^l(t)$ of the mixed signal.

The treatment means 4 serve to treat the representative values $\Phi_i(k,m)$ received by the extractor means 3 in order to determine an estimate of the normalized power $\phi'_i(k,m)$ of the source signals to be separated in the time-frequency plane. The estimates of the normalized power $\phi'_i(k,m)$ of the source signals to be separated are then transmitted to the filter means 5.

The transforms $S_{mix}^r(k,m)$ and $S_{mix}^l(k,m)$ of the channels of the mixed signal in the time-frequency plane delivered by the transform means 2, the estimates of the normalized powers of the particular source signals $\phi'_i(k,m)$, and the distributions $a_1^l, \ldots, a_p^l, a_1^r, \ldots, a_p^r$ of the particular source signals between the two channels $s_{mix}^r(t)$ and $s_{mix}^l(t)$ of the mixed digital audio signal are thus delivered to the filter means 5.

The filter means 5 serve to obtain an estimate $S'_i(k,m)$ of each particular source signal by performing spatial filtering. In the time-frequency plane, the filter means 5 serve to isolate the particular source signal by performing linearly constrained minimum variance spatial filtering. More particularly, the filter means 5 are based on the distribution of said particular source signal between the two channels of the mixed signal in order to isolate the particular source signal: this is thus spatial filtering or "beamforming". Furthermore, in order to improve the filtering and the resulting estimate of the source signal, the spatial filter uses the normalized power of the particular source signal that is to be separated as a linear constraint in order to obtain an estimate that is closer to the original source signal.

More precisely, in the time-frequency plane, the following applies:

$$S_{mix}(k,m)=A\cdot S(k,m)$$

with:

$S_{mix}(k,m)=[S_{mix}^l(k,m),S_{mix}^r(k,m)]^T$ and $S(k,m)=[S_1(k,m), \ldots, S_p(k,m)]^T$ Each mixed signal $S_{mix}^r(k,m)$ and $S_{mix}^l(k,m)$ is then decomposed into estimates of particular source signals $S'_1(k,m), \ldots, S'_p(k,m)$ by using the following linear spatial filtering:

$$S'_i(k,m)=w_{ik}^l\cdot S_{mix}^l(k,m)+w_{ik}^r\cdot S_{mix}^r(k,m)=W_{ik}^T\cdot S_{mix}(k,m)$$

with: $W_{ik}=[W_{ik}^l, W_{ik}^r]^T$ and $S'_i(k,m)=[S'_i(k,m), S'_i{}^r(k,m)]^T$.

$W_{ik}$ is the spatial filter or "beamformer" serving to obtain the estimate $S'_i(k,m)$ of the $i^{th}$ source signal in the subband k from the mixed signal $S_{mix}(k,m)$.

For a linearly constrained minimum variance spatial filter, the sum of all of the interfering source signals with the exception of the signal that is to be filtered is considered as being noise. Thus, the mixed signal may be rewritten as follows:

$$S_{mix}(k,m)=a_i\cdot S_i(k,m)+r(k,m)$$

where r(k,m) is the sum of the other source signals.

The estimate $S'_i(k,m)$ is obtained by minimizing the mean noise power, or in equivalent manner, the mean power of the output from the spatial filter in the direction of the source signal that is to be separated:

$$P(\theta_i)=W_{ik}^T(m)\cdot R'_{s_{mix}}(k,m)\cdot W_{ik}(m)$$

where $R_{s_{mix}}$ is the spatial correlation matrix of the two channels $S_{mix}^{r}(k,m)$ and $S_{mix}^{l}(k,m)$ of the mixed signal $S_{mix}(k,m)$.

The solution is given by:

$$W_{ik}(m) = R'^{-1}_{S_{mix}}(k,m)\cdot a_i \cdot \sqrt{\frac{\varphi'_i(k,m)}{a_i^T \cdot R'^{-1}_{S_{mix}}(k,m)\cdot a_i}}$$

This gives:

$$S'_i(k,m) = \sqrt{\frac{\varphi'_i(k,m)}{a_i^T \cdot R'^{-1}_{S_{mix}}(k,m)\cdot a_i}} \cdot a_i^T \cdot R'^{-1}_{S_{mix}}(k,m)\cdot S_{mix}(k,m)$$

with: $R'^{-1}_{s_{mix}}(k,m)=\Sigma\phi'_i(k,m)\cdot a_i\cdot a_i^T$.

Once applied to the mixed signal $S_{mix}(k,m)$, the filter that is obtained serves to reduce the contributions to the power spectrum from the other signals. Furthermore, because of the linear constraint, the power of the estimated source signal corresponds to the power of the initial source signal for the various points of the time-frequency plane (which may be verified by reinjecting the solution $W_{ik}$ into the equation defining $P(\theta_i)$). Thus, the filter means 5 serve to decorrelate the $i^{th}$ source signal spatially from the remainder of the mixed signal, while adjusting the amplitude of said decorrelated signal to the desired level.

When the quantity of watermarked information in the mixed signal is too great for the noise of the watermarking to be ignored, it may also be observed that it is possible to adjust the components of the estimated source signals as follows:

$$S'_i(k,m)=S'_i(k,m)\cdot(\sqrt{\phi'_i(k,m)})/|S'_i(k,m)|$$

The transforms of the estimates of the separated particular source signals are then transmitted to the inverse transform means 6. The means 6 serve to transform the transforms of the estimates of the separated source signals into time signals $s'_1(t), \ldots, s'_p(t)$ that correspond, at least in part, to the source signals $s_1(t), \ldots, s_p(t)$.

Figure 2:
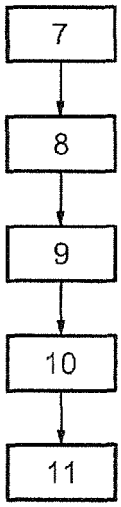
FIG. 2 is a flow chart of a separation method of the disclosure.

FIG. 2 is a flow chart showing the various steps of the separation method of the disclosure.

The method comprises a first step 7 during which the mixed signal is transformed into a time-frequency plane. Thereafter, in a step 8, information that has been watermarked in the mixed signal is extracted, in particular the representative values and the distributions of the source signals between at least two channels of the mixed signal. During a step 9, the normalized powers of the source signals for separating are determined, and then during a step 10, linearly constrained minimum variance spatial filtering is performed, with the constraint being the normalized power of the source signal that is to be separated. Finally, in a step 11, a transform is performed that is the inverse of the transforms of the separated particular source signals so as to obtain the particular source signals, at least in part.

With audio signals, it is thus possible to output from the separator system of the disclosure a certain number of major controls in audio listening (volume, tone, effects), in independent manner on the various elements of the sound scene (instruments and voices obtained by the separator device).

The invention claimed is:

1. A method of separating, at least in part, one or more particular digital audio source signals contained in a mixed multichannel digital audio signal, the mixed signal being obtained by mixing a plurality of digital audio source signals and including representative values of the particular source signal(s), the method comprising:

determining the modulus of the amplitude or the normalized power of the particular source signal(s) from the representative values in the time-frequency plane of said particular source signal(s) contained in the mixed signal; and then performing linearly constrained minimum variance spatial filtering in order to obtain, at least in part, each particular source signal, said filtering being based on the distribution of said particular source signal between at least two channels of the mixed signal, and the modulus of the amplitude or the normalized power of said particular source signal being used as a linear constraint of the filter.

2. The method according to claim 1, wherein the mixed signal includes representative values of the particular source signal(s) for at least two channels of the mixed signal, and wherein, prior to performing spatial filtering, the mixed signal and said representative values of the particular signals are used to determine the distribution of each particular source signal between said at least two channels of the mixed signal.

3. The method according to claim 1, wherein the distribution of the particular source signal(s) between at least two channels of said mixed signal is received as input.

4. The method according to claim 1, wherein determining the modulus of the amplitude or the normalized power of the particular source signal(s) comprises extracting representative values of the particular source signals that have been inserted into the mixed signal.

5. The method according to claim 1, wherein the modulus of the amplitude or the normalized power of said particular source signal are spectro-temporal values.

6. A device for separating, at least in part, one or more particular digital audio source signals contained in a multichannel mixed digital audio signal, the mixed signal being obtained by mixing a plurality of digital audio source signals and including representative values of the particular source signal(s), the device comprising:

determination means for determining the modulus of the amplitude or the normalized power of the particular source signal(s) from the representative values in the time-frequency plane of said particular source signal(s) contained in the mixed signal; and a linearly constrained minimum variance spatial filter adapted to isolate, at least in part, each particular source signal from the mixed signal, said filter being based on the distribution of said particular source signal between at least two channels of the mixed signal, and the modulus of the amplitude or the normalized power of said particular source signal being used as a linear constraint.

7. The device according to claim 6, wherein the mixed signal includes representative values of the particular source signal(s) for at least two channels of the mixed signal, the device including determination means for determining the distribution of each particular source signal between said at least two channels of the mixed signal from the mixed signal and from said representative values of the particular source signals.

8. The device according to claim 6, also including an extractor configured to extract the representative values of the particular source signal(s) that have been inserted in the mixed signal.

9. The method according to claim 3, wherein the distribution of the particular source signal(s) between at least two channels of said mixed signal are received in the mixed signal.

10. The method according to claim 4, wherein determining the modulus of the amplitude or the normalized power of the particular source signal(s) comprises extracting representative values of the particular source signals that have been inserted into the mixed signal by watermarking.

11. The device according to claim 8, wherein the extractor is configured to extract the representative values based on watermarking.

* * * * *